US005863025A

United States Patent [19]

Noya

[11] Patent Number: 5,863,025

[45] Date of Patent: Jan. 26, 1999

[54] EVAPORATOR CONTROL VALVE PROVIDED WITH A SOLENOID FOR USE IN DIAGNOSING TROUBLE

[75] Inventor: Tamotsu Noya, Sashima-gun, Japan

[73] Assignee: Kyosan Denki Co., Ltd., Tokyo, Japan

[21] Appl. No.: 606,208

[22] Filed: Feb. 23, 1996

[30] Foreign Application Priority Data

Mar. 27, 1995 [JP] Japan ..... 7-091916

[51] Int. Cl.[6] ..... F02M 33/02

[52] U.S. Cl. ..... 251/129.17; 123/516; 123/519

[58] Field of Search ..... 251/129.17; 123/516, 123/518, 519, 520

[56] References Cited

U.S. PATENT DOCUMENTS

| | | | |
|---|---|---|---|
| 3,424,429 | 1/1969 | Monnich | 251/129.17 |
| 4,930,747 | 6/1990 | Nakamura | 251/129.17 |
| 5,211,151 | 5/1993 | Nakajima et al. | 123/520 |
| 5,419,367 | 5/1995 | Noya | 251/129.17 X |
| 5,469,886 | 11/1995 | Noya | 123/520 X |

FOREIGN PATENT DOCUMENTS

| | | | |
|---|---|---|---|
| 0123068 | 9/1980 | Japan | 251/129.17 |
| 6--6930 | 1/1994 | Japan . | |
| 6-263261 | 10/1994 | Japan . | |

*Primary Examiner*—John Rivell

*Attorney, Agent, or Firm*—Flynn, Thiel, Boutell & Tanis, P.C.

[57] ABSTRACT

An evaporator control valve is capable of opening a diaphragm in a desired pressure, thereby preventing a fuel tank from being deformed owing to negative pressure in the fuel tank, and also the evaporator control valve is provided with a solenoid for diagnosing trouble capable of forcibly opening or closing the diaphragm only at the time when an evaporating system is diagnosed. An atmospheric pressure chamber is formed on the upper surface of the diaphragm for communicating with the atmosphere, and a spring is disposed on the upper surface of the diaphragm for biasing the diaphragm downward, while a tank side chamber for communicating with the fuel tank and a canister side chamber for communicating with a canister are respectively formed on the lower surface of the diaphragm, and the slit valve is integrally formed with the diaphragm, wherein the tank side chamber and the canister side chamber are allowed to communicate with each other by way of the diaphragm or the slit valve, wherein the diaphragm is forcibly opened or closed by the plunger to be driven by the solenoid disposed inside the atmospheric pressure chamber.

6 Claims, 1 Drawing Sheet

FIGURE
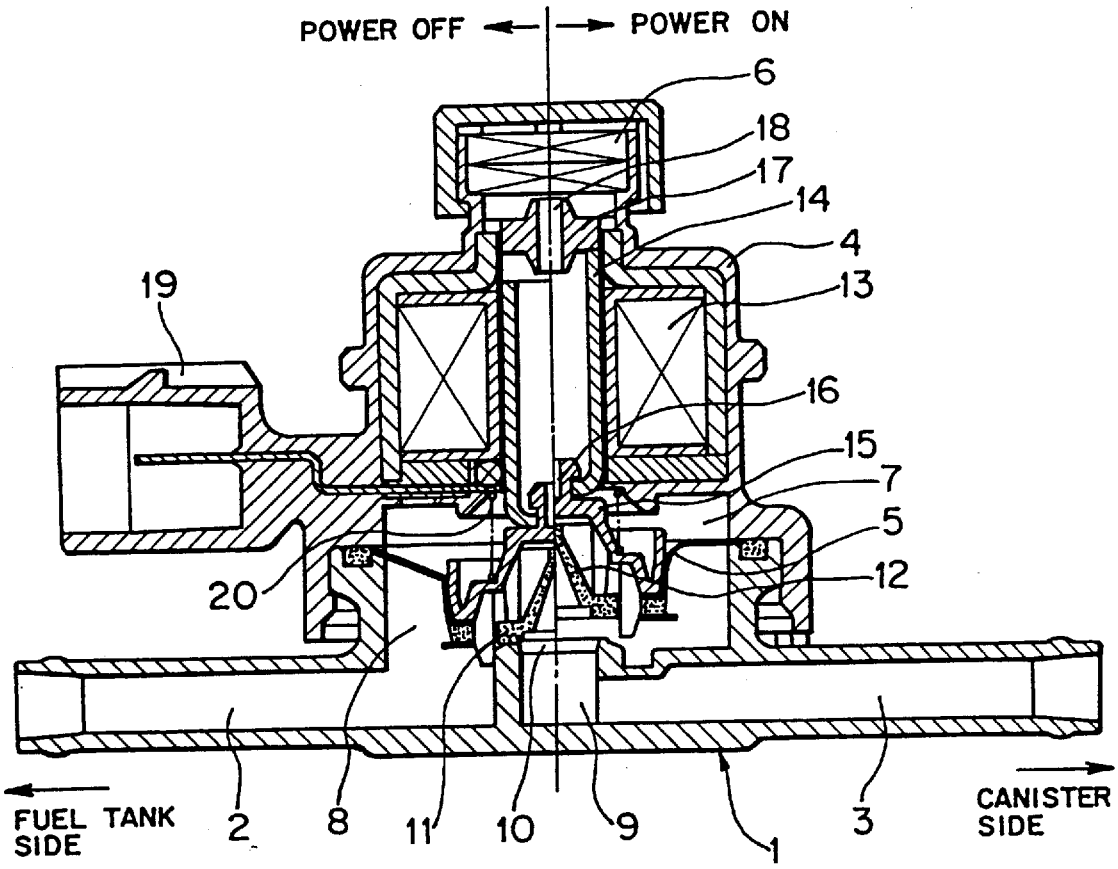

EVAPORATOR CONTROL VALVE PROVIDED WITH A SOLENOID FOR USE IN DIAGNOSING TROUBLE

DETAILED DESCRIPTION OF THE INVENTION

1. Field of the Invention

The present invention relates to an evaporator control valve for supplying evaporated fuel generated in a fuel tank to a canister, and also supplying atmospheric air from a canister side to the fuel tank when an inside of the fuel tank is negatively pressurized so as to diagnose trouble of an evaporating system.

2. Prior Art

There is known an evaporator control valve for supplying evaporated fuel generated in a fuel tank to a canister, and also supplying atmospheric air from a canister side to the fuel tank when an inside of the fuel tank is negatively pressurized so as to diagnose trouble of an evaporating system, for example, as disclosed in Japanese Patent Publication No. 6-6930.

An evaporator control valve comprises a chamber for communicating with an intake manifold and a spring for biasing the diaphragm downward which are respectively disposed on an upper surface of a diaphragm, a tank side chamber for communicating with a fuel tank and a canister side chamber for communicating with a canister which are respectively provided on a lower surface of the diaphragm, wherein a slit valve is integrally formed with the diaphragm, and the tank side chamber and the canister side chamber communicate with each other by way of the diaphragm or the slit valve.

Whereupon, in the conventional evaporator control valve, since the upper surface of the diaphragm forms a chamber for communicating with the intake manifold and the diaphragm is opened due to negative pressure in the intake manifold, the diaphragm is always opened during the traveling of an automobile. For example, when a negative pressure is generated in the canister, the negative pressure is led into the fuel tank, thereby leading to a possibility of deforming the fuel tank.

Accordingly, the inventor of the present application has made an invention of an evaporator control valve capable of opening a diaphragm in a desired positive pressure so as to prevent the fuel tank from being deformed owing to negative pressure in the fuel tank, then the applicant has filed the invention as disclosed in Japanese Patent Application No. 6-263261. Meanwhile, although the evaporator control valve of this prior art invention is excellent in preventing the fuel tank from being deformed owing to the negative pressure when it is used normally, it has however the following drawback. That is, even if the inside of the fuel tank is intended to be negatively pressurized to an extent of, e.g., 500 mAq for diagnosing the trouble of evaporating system, the diaphragm is not opened unless the fuel tank is in a positive pressure. Accordingly, it is necessary to consider that the negative pressure generated in the intake manifold is led into the fuel tank while adopting a special route for diagnosing the trouble of the evaporating system or the inside of the fuel tank is negatively pressurized using a special negative pressure generating apparatus.

The present invention has been made in view of the aforementioned problems, and it is an object of the present invention to provide an evaporator control valve provided with a solenoid for use in diagnosing trouble capable of opening a diaphragm in a desired positive pressure, and capable of preventing a fuel tank from being deformed owing to negative pressure, and also capable of forcibly opening or closing the diaphragm.

To achieve the above object, according to a first aspect of the invention, the evaporator control valve provided with a solenoid for use in diagnosing trouble disposed in a piping connecting between a fuel tank and a canister is characterized in comprising a diaphragm having a slit valve integrated therewith, an atmospheric pressure chamber for communicating with the atmosphere and a spring for biasing the diaphragm downward, the atmospheric pressure chamber and the spring being respectively arranged on an upper surface of the diaphragm, a solenoid being disposed inside the atmospheric pressure chamber, a plunger disposed along an inner periphery of the solenoid, a tank side chamber for communicating with the fuel tank and a canister side chamber for communicating with the canister being respectively provided on a lower surface of the diaphragm, wherein the tank side chamber and the canister side chamber communicate with each other by way of the diaphragm or the slit valve so that the diaphragm is forcibly opened or closed by the plunger when the plunger is driven by the solenoid.

According to a second aspect of the invention, the evaporator control valve provided with a solenoid for use in diagnosing trouble is characterized in further comprising a valve presser member having a snap portion for pressing the diaphragm downward, and a hook portion provided at a lower end of the plunger wherein the hook portion is retained by the snap portion.

With the arrangement of the evaporator control valve provided with a solenoid for use in diagnosing trouble, when the pressure in the fuel tank is increased by evaporated fuel and it reaches a desired positive pressure which exceeds a biasing force caused by a spring, the diaphragm is opened so as to supply the evaporated fuel in the fuel tank to the canister side. Further, when the pressure in the fuel tank becomes lower than that in the canister side, air is supplied from the canister side into the fuel tank so as to prevent the inside of the fuel tank from being negatively pressurized.

Further, in the case of leading the negative pressure generated in the intake manifold to the fuel tank at need, at the time when the trouble of the evaporating system is diagnosed, the solenoid is energized to thereby allow the diaphragm to be forcibly opened by the plunger, so that the negative pressure generated in the intake manifold is led from the canister side into the fuel tank so as to be utilized for diagnosing the trouble of the evaporating system. Since this diagnosis is not always performed but temporarily performed, the inside of the fuel tank is not liable to be damaged owing to the negative pressure.

Even if the plunger is oscillated to the right and left due to an external oscillation while the diaphragm is closed at the time excepting the diagnosis of trouble of the evaporating system, when the hook portion formed at the lower end of the plunger is snap to fit in the snap portion of the valve presser member, the oscillation of the plunger to the right and left does not affect the diaphragm.

PREFERRED EMBODIMENT OF THE DRAWING

A single figure is a cross sectional view of an evaporator control valve provided with a solenoid for use in diagnosing trouble according to a preferred embodiment of the invention.

DETAILED DESCRIPTION

In a single figure, an evaporator control valve comprises a body 1, a fuel tank side communication pipe 2 to which a communication pipe is attached for communicating with a fuel tank, not shown, and a canister side communication pipe 3 to which a communication pipe is attached for communicating with a canister, not shown, wherein the fuel tank side communication pipe 2 and the canister side communication pipe 3 are respectively disposed in the body 1. The body 1 is covered with a cap 4.

A diaphragm 5 is interposed between and clamped by the body 1 and the cap 4. An atmospheric pressure chamber 7 is formed on an upper surface of the diaphragm 5 for communicating with the atmosphere by way of an air cleaner 6 disposed over the cap 4.

A tank side chamber 8 for communicating with the fuel tank side communication pipe 2 and a canister side chamber 9 for communicating with the canister side communication pipe 3 are respectively formed on the lower surface of the diaphragm 5 in the body 1. The tank side chamber 8 and the canister side chamber 9 are partitioned by a seal portion 11 of the diaphragm 5 which is positioned on a valve seat 10 formed on an upper end of the canister side chamber 9.

A slit valve 12 is integrally formed with the diaphragm 5 and is disposed inside the seal portion 11 for allowing air to flow from the canister side chamber 9 to the tank side chamber 8.

A solenoid 13 is disposed inside a cap 4 and a plunger 14 is disposed along an inner periphery of the solenoid 13 so as to be movable vertically. A lower end of the plunger 14 is bent inwardly like a hook (hereinafter referred to as a hook portion) and is retained by a snap portion 16 of a valve presser member 15. The snap portion 16 is preferably embodied by a projection extending from an upper surface of the valve presser member 15, which projection has a recessed portion in which the hook portion of plunger 14 engages. A stopper 17 is disposed over the plunger 14 and an atmosphere vent 18 is formed in the stopper 17 at the center thereof.

When the solenoid 13 is not energized, the plunger 14 lowers owing to its own weight and its upper end confronts the stopper 17 with an interval. The hook portion of the plunger 14 is retained by the snap portion 16 of the valve presser member 15 so as to be slidable to an extent relative the snap portion 16. When the solenoid 13 is energized upon reception of power from a power connector 19, the plunger 14 rises together with the diaphragm 5 while the hook portion thereof remains contacting with the upper surface of the snap portion 16 of the valve presser member 15 until the upper end thereof contacts the stopper 17. With such an operation, the diaphragm 5 is forcibly opened.

In the evaporator control valve having such an engagement, pressure in the fuel tank is normally increased by evaporated fuel and this pressure is supplied to the tank side chamber 8 so as to operate to push up the diaphragm 5. If the pressure in the fuel tank reaches a desired positive pressure exceeding a biasing force caused by a spring 20, the diaphragm 5 is opened, thereby forming a flow passage for allowing the evaporated fuel in the fuel tank to flow from the tank side chamber 8 to the canister side chamber 9 through a valve seat 10. When the pressure in the fuel tank becomes lower than that of the canister side, a flow passage from the canister side chamber 9 to the tank side chamber 8 by way of the slit valve 12 is formed so as to allow air to supply from the canister side to the fuel tank, thereby preventing the inside of the fuel tank from being negatively pressurized.

As mentioned above, since the diaphragm 5 is opened when the pressure in the fuel tank is increased to reach a desired positive pressure exceeding the urging force caused by the spring, the diaphragm 5 is not always opened even if an intake manifold is negatively pressurized to thereby allow the canister to be negatively pressurized during the traveling of an automobile. As a result, the negative pressure at the canister side does not affect the fuel tank.

In the case of leading the negative pressure generated in the intake manifold to the fuel tank, at need, at the time when the trouble of the evaporating system is diagnosed, the solenoid 13 is urged so that the diaphragm 5 is forcibly opened by the plunger 14, so that a desired negative pressure generated in the intake manifold is led to the fuel tank by way of the canister side chamber 9, the valve seat 10 and the tank side chamber 8. As a result, the negative pressure led to the fuel tank is utilized for diagnosing the trouble of the evaporating system. Since such a diagnosis of trouble is not always performed but temporarily performed, even if the inside of the fuel tank is negatively pressurized temporarily, there is no likelihood that the fuel tank is damaged by the negative pressure.

Even if the plunger 14 is oscillated to the right and left due to the external oscillation while the diaphragm 5 is closed at the time excepting the diagnosis of trouble of the evaporating system, when the hook portion formed at the lower end of the plunger 14 is snap to fit in the snap portion 16 of the valve presser member 15, the oscillation of the plunger 14 to the right and left does not affect the diaphragm 5, thereby preventing generation of a gap in the valve seal portion 11. As a result, there is no likelihood of leakage of the gas from a gap in the valve seal portion 11.

As mentioned in detail above, the evaporator control valve is capable of opening the diaphragm 5 in a desired pressure, thereby preventing the fuel tank from being deformed owing to a negative pressure in the fuel tank, and also the evaporator control valve is provided with the solenoid for diagnosing trouble capable of forcibly opening or closing the diaphragm only at the time when the evaporating system is diagnosed.

The atmospheric pressure chamber 7 is formed on the upper surface of the diaphragm 5 for communicating with the atmosphere, and the spring 20 is disposed on the upper surface of the diaphragm 5 for biasing the diaphragm downward, while the tank side chamber for communicating with the fuel tank and the canister side chamber for communicating with the canister are respectively formed on the lower surface of the diaphragm. The slit valve 12 is integrally formed with the diaphragm, wherein and the tank side chamber 8 and the canister side chamber 9 are allowed to communicate with each other by way of the diaphragm 5 or the slit valve 12. Further, the outer side of the seal portion 11 faces the tank side chamber 8 and the inner side of the seal portion 11 faces the canister side chamber 9. As a result, the evaporator control valve according to the present invention, when the pressure in the fuel tank is increased due to evaporated fuel to reach a desired positive pressure exceeding the urging force caused by the spring 20, the diaphragm 5 is opened to thereby supply the evaporated fuel in the fuel tank to the canister side while when the pressure in the fuel tank becomes lower than that of the canister side, air is supplied from the canister side into the fuel tank by way of the slit valve 12, thereby preventing the inside of the fuel tank from being negatively pressurized, so that the evaporated fuel in the fuel tank can be surely supplied to the canister side and fuel tank is prevented from being deformed due to the negative pressure. Any negative pressure present at the canister side 3 assists in holding the diagram 5 closed.

In the arrangement as mentioned above, since the diaphragm 5 is forcibly opened or closed by the plunger 14 to be driven by the solenoid 13 disposed inside the atmospheric pressure chamber 7, in the case of leading the negative pressure generated in the intake manifold to the fuel tank, at need, at the time when the trouble of the evaporating system is diagnosed, the solenoid 13 is urged to thereby allow the diaphragm 5 to be forcibly opened by the plunger 14, so that the desired negative pressure generated in the intake manifold is led from the canister side into the fuel tank so as to be utilized for diagnosing the trouble of the evaporating system. As a result, it is possible to provide the compact evaporator control valve provided with a solenoid for use in diagnosing trouble without using a special route for diagnosing the trouble or a special negative pressure generating apparatus.

Even if the plunger 14 is oscillated to the right and left due to an external oscillation while the diaphragm 5 is closed at the time excepting the diagnosis of trouble of the evaporating system, when the hook portion formed at the lower end of the plunger 14 is snap to fit in the snap portion of the valve presser member 15, the oscillation of the plunger 14 to the right and left does not affect the diaphragm 5. As a result, it is possible to provide the excellent evaporator control valve provided with a solenoid for use in diagnosing trouble capable of preventing generation of a gap in the valve seal portion, thereby preventing the evaporated fuel or air from being leaked through the gap.

What is claimed is:

1. An evaporator control valve disposed between a fuel tank and a canister, said evaporator control valve comprising:

a housing having a wall portion defining a canister-side passage which communicates with the canister and which terminates at a canister side chamber, said wall portion defining a valve seat surrounding an opening communicating with said canister side chamber;

a diaphragm valve disposed to cooperate with said valve seat, said diaphragm valve including:

a diaphragm having a first surface and a second surface facing away from one another, a slit valve carried by said diaphragm having an annular seal portion formed thereon, said slit valve defining an interior chamber in communication with and forming part of said canister side chamber;

said diaphragm valve having a closed position wherein said seal portion is in sealing contact with said valve seat and an open position wherein said seal portion and said valve seat are out of contact with one another;

said housing defining a fuel-side passage in communication with the fuel tank, said fuel-side passage terminating at a tank side chamber which exteriorly surrounds said slit valve and communicates with said interior chamber and said canister side chamber through one of said slit valve and said diaphragm valve;

a spring disposed at said first surface of said diaphragm to provide a biasing force to bias said diaphragm valve into said closed position;

said tank side chamber and said canister side chamber being disposed at said second surface of said diaphragm;

a solenoid disposed adjacent said diaphragm valve and including a movable plunger engaged with a portion of said diaphragm valve such that upon said solenoid being energized, said diaphragm valve moves along with said plunger into said open position to permit temporary negative pressurization of said fuel side chamber from said canister side chamber;

said diaphragm valve being moved into said open position when pressure-generated force imposed on said diaphragm valve in said tank side chamber exceeds the biasing force of said spring; and said slit valve being configured and disposed for permitting flow of air from said interior chamber and said canister side chamber to said tank side chamber when said tank side chamber has a pressure less than the pressure in said canister side chamber and said diaphragm valve is in said closed position.

2. The evaporator control valve according to claim 1, wherein said diaphragm valve has a central axis, and said diaphragm, said slit valve and said seal portion all being disposed substantially concentrically about the axis.

3. The evaporator control valve according to claim 1, wherein said seal portion and said slit valve are integral with one another and form a single member.

4. The evaporator control valve according to claim 1, wherein said diaphragm valve has a central longitudinal axis and said slit valve projects in the axial direction away from said valve seat and said canister side chamber.

5. An evaporator control valve disposed between a fuel tank and a canister, said evaporator control valve comprising:

a housing defining a tank side chamber disposed to communicate with the fuel tank, a canister side chamber disposed to communicate with the canister, and a valve seat surrounding a communication opening between said tank side chamber and said canister side chamber;

a diaphragm valve disposed to cooperate with said valve seat, said diaphragm valve including:

a diaphragm having a first surface and a second surface facing away from one another, a slit valve carried by said diaphragm, and an annular seal portion, said diaphragm valve having a closed position wherein said seal portion is in sealing contact with said valve seat and an open Position wherein said seal portion and said valve seat are out of contact with one another;

a spring disposed at said first surface of said diaphragm to provide a biasing force to bias said diaphragm valve into said closed position;

said tank side chamber and said canister side chamber being disposed at said second surface of said diaphragm;

a solenoid disposed adjacent said diaphragm valve and including a movable plunger engaged with a portion of said diaphragm valve such that upon said solenoid being energized, said diaphragm valve moves along with said plunger into said open position to permit temporary negative pressurization of said fuel side chamber from said canister side chamber;

said diaphragm valve being moved into said open position when pressure-generated force imposed on said diaphragm valve in said tank side chamber exceeds the biasing force of said spring;

said slit valve being configured and disposed for permitting flow of air from said canister side chamber to said tank side chamber when said tank side chamber has a pressure less than the pressure in said canister side chamber and said diaphragm valve is in said closed position;

said diaphragm valve further including a valve presser member disposed between said diaphragm and said plunger and cooperating with said spring to bias said diaphragm valve into said closed position, said valve presser member including a projection having a recess disposed therein;

said plunger having an end disposed adjacent said diaphragm valve, said end including a generally hook-shaped portion engaged in said recess of said projection to connect said diaphragm valve to said plunger for movement therewith; and said recess being a size sufficient to permit oscillations of said end of said plunger with respect to said valve presser member.

6. The evaporator control valve according to claim 5, wherein said housing includes an atmospheric pressure chamber for communicating with the atmosphere, said atmospheric pressure chamber being disposed at said first surface of said diaphragm, said solenoid being disposed in said atmospheric pressure chamber.

* * * * *